FIP8106 XR 4,028,977

United States Patent [19]

Ryeczek

[11] 4,028,977

[45] June 14, 1977

[54] OPTOELECTRONIC SOUND AMPLIFIER SYSTEM FOR MUSICAL INSTRUMENTS

[76] Inventor: John Joseph Ryeczek, R.D. No. 1, Box 190C, Point Marion, Pa. 15474

[22] Filed: Nov. 17, 1975

[21] Appl. No.: 632,306

[52] U.S. Cl. ..... 84/1.16; 250/199; 84/1.18

[51] Int. Cl.[2] ..... G10H 3/00

[58] Field of Search ..... 84/1.01, 1.14–1.16, 84/1.18, DIG. 19; 250/199

[56] References Cited

UNITED STATES PATENTS

| | | | |
|---|---|---|---|
| 1,692,011 | 9/1927 | Chubb | 250/199 |
| 1,948,996 | 2/1934 | Toulon | 84/1.18 |
| 2,039,659 | 5/1936 | Ranger | 84/1.18 X |
| 2,603,118 | 7/1952 | Ducont | 84/1.18 |
| 2,666,650 | 1/1954 | MacDonell | 84/1.18 |
| 2,707,749 | 5/1955 | Mueller | 250/199 |
| 3,038,363 | 6/1962 | Miessner | 84/1.14 |
| 3,528,011 | 9/1970 | Anderson | 250/199 |
| 3,624,264 | 11/1971 | Lazarus | 84/1.14 |

*Primary Examiner*—Ulysses Weldon
*Attorney, Agent, or Firm*—Webb, Burden, Robinson & Webb

[57] ABSTRACT

An optoelectronic sound amplifier system for musical instruments such as guitars, drums and the like, which includes light reflecting means positioned on the surface of the musical instrument adapted to vibrate responsive to the musical vibrations of the instrument. Light rays originating from a remote source strike the vibrating reflecting means and are modulated thereby in accordance with the musically induced vibrations of the reflecting means. The reflected and modulated light rays are received at a station remote from the musical instrument within which the rays strike a photo-electric transducer device. The photo-electric device produces an electronic signal corresponding to the musical tones associated with the modulated light rays which may then be amplified through one or more conventional amplifier-speaker units.

12 Claims, 6 Drawing Figures

D.C. preferred to 60 ~

OPTOELECTRONIC SOUND AMPLIFIER SYSTEM FOR MUSICAL INSTRUMENTS

BACKGROUND OF THE INVENTION

My invention relates generally to sound amplifier systems for musical instruments and more particularly to an optoelectronic amplifier in which the musical vibrations of the instrument are transmitted by reflected light rays to a photo-electric receiver device and amplified into audible tones.

The principle of transmitting sound by modulated and reflected light rays is old as evidenced by the early patent to Bell et al. U.S. Pat. No. 235,496. It is also well known to utilize a photoelectric cell to convert the modulated light rays into an electronic signal as shown in U.S. Pat. Nos. 3,065,352 and 3,733,953.

Conventional electronic amplifier systems for musical instruments possess several deficiencies which are not present in my system. Conventional amplification systems generally utilize a heavy magnetic core positioned within the instrument which not only adds additional weight to the instrument, but also tends to deaden the acoustics of the instrument. Further, conventional systems utilize a cord extending from the instrument to the amplifier units which is sometimes cumbersome for the musician.

My invention solves many of these problems by providing an amplification system for musical instruments wherein very little, if any, additional weight is added to the instruments so that the acoustical characteristics of the instrument is not changed by any significant degree. Further, my amplification system eliminates the need for a cord extending from the instrument to the amplifier or power locations.

SUMMARY OF THE INVENTION

Briefly, my invention provides an optoelectronic amplifier system for musical instruments, particularly, stringed instruments such as guitars. Light reflecting means such as a mirror is positioned on a surface of the instrument such that the mirror vibrates responsive to the musical vibrations of the instrument. Light rays transmitted from a remote source strike the vibrating reflecting means and are modulated thereby in accordance with the musically induced vibrations of the mirror. Receiving means located at a point remote from the musical instrument receive the reflected and modulated light rays from the instrument. The receiving means includes a photo-electric device which produces electronic signals corresponding to the musical tones associated with the modulated light rays and feeds said signals to conventional amplifier-speaker means to amplify the electronic signals to produce audible sounds.

Various other features and advantages of my invention will be better understood when reference is made to the following description and the accompanying drawings wherein.

DETAILED DESCRIPTION OF THE PREFERRED EMBODIMENTS

Figure 1:
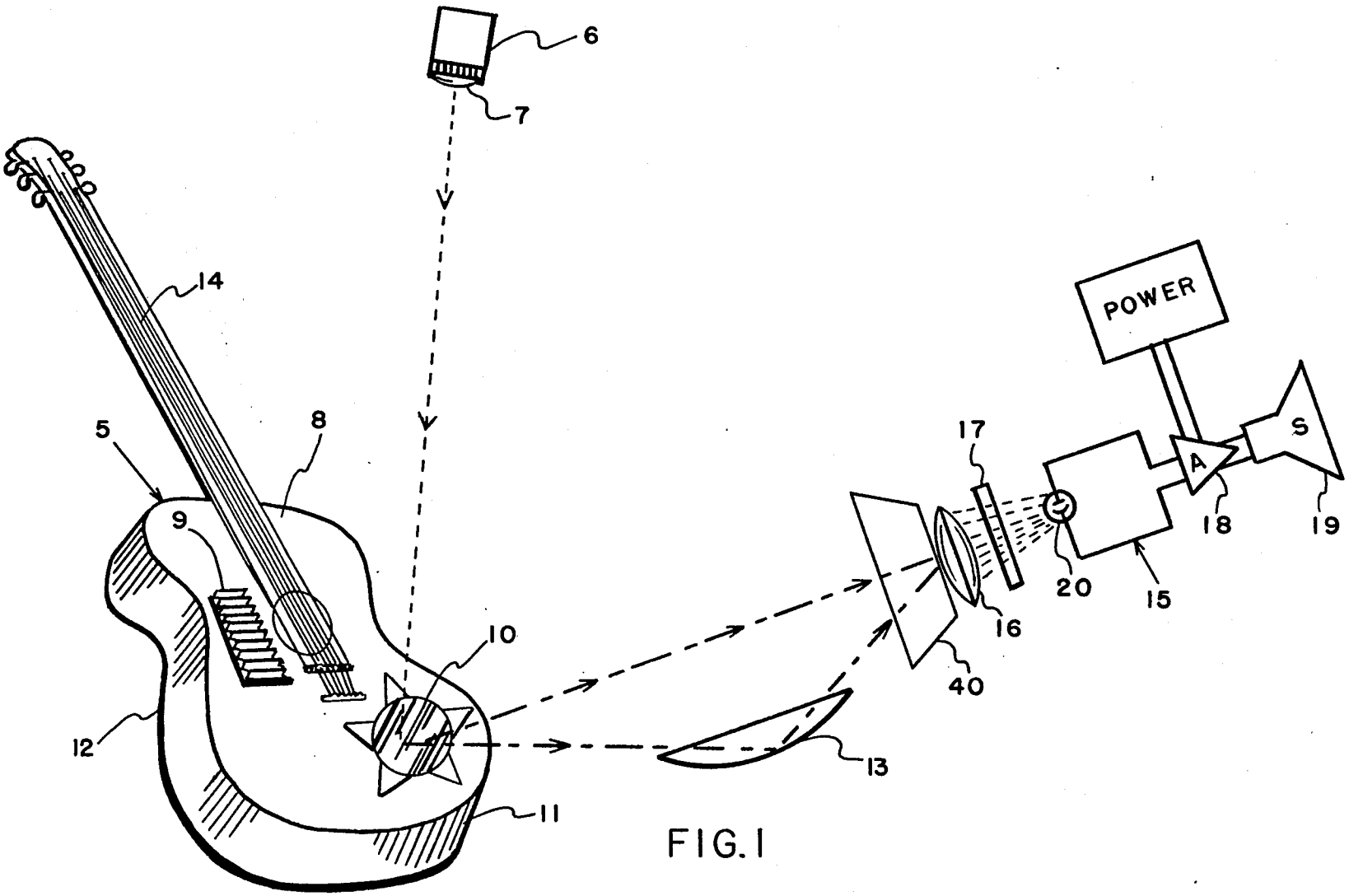
FIG. 1 is a schematic diagram of my invention showing an external light source and a guitar having a mirror positioned thereon and a receiving amplification station spaced therefrom.
Figure 5:
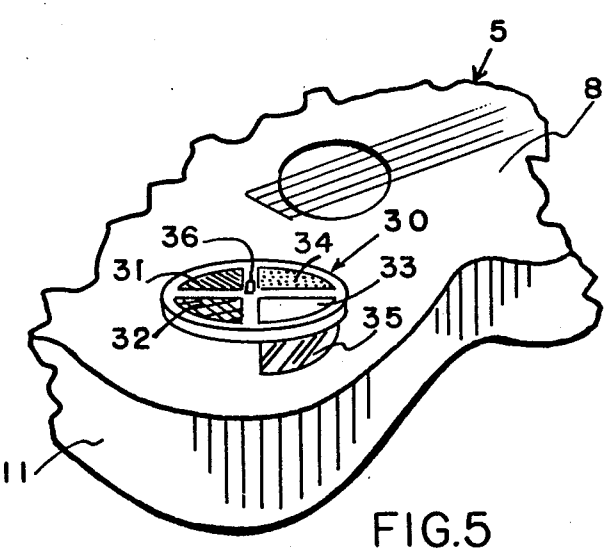
FIG. 5 is a fragmentary perspective view of a guitar showing a rotatable colored disc positioned above the light reflecting means to control the intensity of the reflected light rays.

One presently preferred embodiment of my amplifier system is schematically depicted in FIG. 1 in which the invention is shown in combination with a guitar 5. While my invention is particularly suited for stringed instruments, such as guitars, it is understood that it may also be utilized in connection with any musical instruments which acoustically vibrate, for example, horns or drums. Guitar 5 includes strings 14, front face 8 adjacent the strings and parallel back face 12 interconnected by sidewall 11. Front face 8 and back face 12 define an open interior therebetween, referred to as the sound box in acoustical guitars. When the guitar is played the sound box vibrates the face portions thereof. Light reflecting means in the form of mirror 10 is positioned on front face 8 of guitar 5. Mirror 10 vibrates responsive to the musical vibrations of the instruments when it is being played. A light source 6, which may be a spotlight or strobe light, or other conventional lighting means, preferably having a lens 7, is positioned at a station remote from the instrument and directed toward mirror 10. It is preferred to operate light source 6 on D.C. power in order to eliminate the hum caused by 60 cycle A.C. It is, of course, understood that artificial light source 6 may be replaced by natural sunlight, if desired. The light rays emitted by source 6 or from the sun strike the vibrating mirror 10 and are modulated in accordance with the musically induced vibrations of mirror 10.

The modulated light rays are reflected from mirror 10 and are directed to a remotely positioned receiving station 15. Station 15 includes a photo-electric transducer device 20 or other photoelectric means which in turn is connected to conventional amplifier 18 and speaker 19. A lens 16 may also be employed between the reflecting mirror 10 and photo-electric device 20 to aid in gathering the light rays and directing them to photo-electric device 20. A filter element 17 may also be positioned in front of photo-electric device 20 to insure that the device 20 is not overloaded by an excess of light. A conical tube 40 is also preferably employed to aid in shielding unwanted overhead lighting and the resultant A.C. hum from the photo cell 20. A conventional low pass filter of the type having inductors and a capacitor could also be employed between photo cell 20 and amplifier 18 to filter out the 60 cycle hum from overhead lighting.

In operation, the reflected, modulated light rays strike the photo-electric device 20 which, in turn, produces electronic signals corresponding to the musical tones associated with the modulated light rays. The signals are then amplified to an audible range through conventional amplifier 18 and speaker 19. Remotely positioned receiver 15 may be driven solely by the power generated by photo-electric device 20 or, alternatively, may be battery powered or powered through an external power source as shown in FIG. 1. Further, receiver 15 may drive a single amplifier-speaker unit or it may be utilized to drive a plurality of amplifier-speaker units in the conventional manner well known in the art.

Still referring to FIG. 1, an intermediate collector-transmitter mirror 13 may also be employed between the musical instrument and the receiving means 15 to aid in directing the reflected, modulated light rays from the guitar to the receiving station 15. Intermediate mirror 13 may be positioned on the floor or it may be positioned overhead if desired. Intermediate mirror 13 is preferably dish or parabolic shaped having a diameter of several feet to provide a large target area for the reflected light thus permitting a greater range of movement for the performer.

Figure 2:
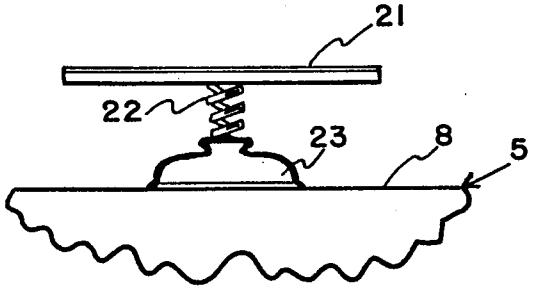
FIG. 2 is a side elevational view of one presently preferred embodiment of the light reflecting means.

By changing the position and shape of the reflecting means 10 various musical effects can be achieved. Further, by selectively shielding, masking or filtering the mirror, the amplified volume may, likewise, be altered. Several of the various presently preferred embodiments of the light reflecting means which may be employed are depicted in FIGS. 2 through 6. In FIG. 2, mirror 21 is planar in shape and is attached at its underside to spring member 22. The plane of mirror 21 is perpendicular to the longitudinal axis of spring 22. The lower end of spring 22 is mounted to suction cup 23 which may be detachably mounted to front face 8 of guitar 5. In this manner, a conventional acoustical guitar may easily be converted for use in my audio amplification system by merely pressing the suction cup 23 thereon. It can be understood that spring 22 adds appreciably to the amplitude of vibration imparted to mirror 21 when the instrument is played. This increased vibratory motion of mirror 21 causes increased modulation of the light rays, which results in a more intensified, amplified sound.

Figure 3:
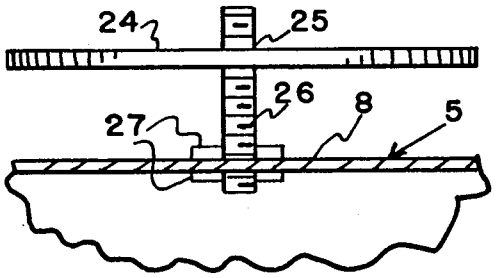
FIG. 3 is a side elevational view similar to FIG. 2 showing another presently preferred embodiment of the light reflecting means.

Another light reflecting arrangement is depicted in FIG. 3 wherein a disc shaped mirror element 24 having a threaded bore 25 is rotatably mounted on threaded shaft 26, which extends outwardly from front face 8 of the guitar. Shaft 26 may be held in place on the guitar by threaded nuts 27 on either side of front face 8. Mirror element 24 may be rotated to permit inward or outward movement of mirror 24 relative to front face 8. When the mirror is in an outermost position on shaft 26, it will oscillate at a greater amplitude than is the case when it is positioned closer to face 8. In this manner, the sound intensity or volume of the instrument may be selectively controlled by the movement of mirror element 24 along shaft 26.

Figure 4:
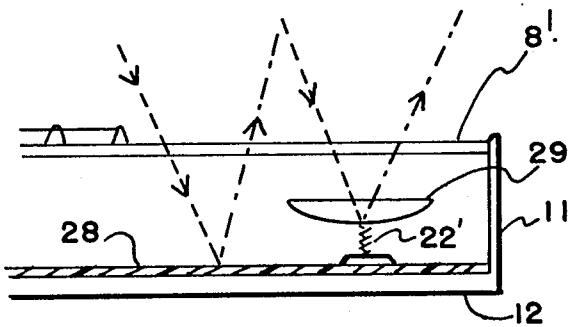
FIG. 4 is a cross-sectional view of a guitar showing two additional embodiments of the light reflecting means which may be employed in my invention.

As shown in FIG. 4, the light reflecting means may also be positioned within the interior of the guitar 5. In such case, front face 8′ of the guitar is constructed of a transparent material, such as clear plastic. The entire inner surface of back face 12 or selected portions thereof may be covered with a light reflecting surface 28. Alternatively, a separate mirror element 29, which is shown as dish shaped mirror, may be positioned within the interior, mounted on spring element 22′ if desired. In either case, the light passes through clear face 8′ and enters the interior of the sound box and strikes the vibrating mirror 28 or 29. The light rays are then modulated and reflected outwardly to be received and amplified at station 15.

The intensity of the sound produced at amplifier 15 may also be controlled by selectively regulating the intensity or brightness of the light rays which strike the reflecting means on the instrument. This intensity control may be effected at the light source 6 through the use of a dimmer or rheostat device or it may be controlled on the instrument itself by use of a colored wheel 30 shown in FIG. 5. Wheel 30 acts as a light filter means and is mounted on a shaft 46 positioned above mirror element 35. Wheel 30 has four segments made up of the transparent, colored glass or plastic 31, 32, 33 and 34. These segments may be of various colors such as clear, amber, green and red, each of which will transmit a different intensity of light to mirror 35 and thus alter the intensity of the light rays received at station 15 to produce sounds of differing loudness.

Figure 6:
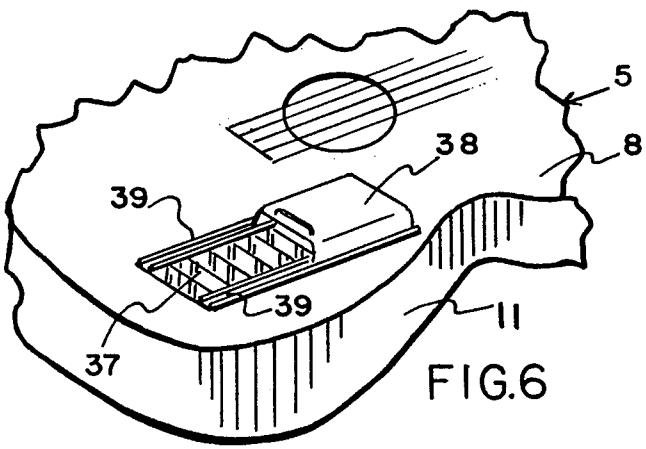
FIG. 6 is a view similar to FIG. 5 showing an additional embodiment of the light reflecting means wherein the intensity of the reflected light may be controlled by way of a slidable cover member.

The intensity of the reflective light may also be controlled through use of the embodiment depicted in FIG. 6. Mirror elements 37 may be selectively covered and uncovered by movement of cover 38 which slidably rides on tracks 39 on the front face 8 of the guitar.

The guitar 5 may also contain other additional elements to take advantage of the wide range of uses for my amplification system. For example, in FIG. 1, guitar 5 has an undulating or washboard surface 9 formed on the front face 8 to provide additional sound generating means for the instrument. The performer may scrape surface 9 with his fingers or with the guitar pick and the additional vibrations generated thereby will influence the vibrations of mirror 10 and the resulting amplified sound. The performer may, likewise, drum upon the guitar with his hands and this drumming sound will also be picked-up at receiver station 15.

While only a single mirror 10 is shown in FIG. 1, a plurality of mirrors may be used on the musical instrument. The mirror element may be glass, plastic, or any type of material having a light reflecting surface which is capable of vibrating with the instrument. An inexpensive material which I have found to be suitable for use as a reflecting means is flexible plastic sheet of the type having a light reflecting surface on one side and a pressure sensitive adhesive on the other, of the type sold under the registered trademark "CON-TACT". It is easily applied directly to the face of the guitar and may be precut into various decorative shapes such as mirror 10 of FIG. 1. This material has a foil-type reflecting surface and is commercially available in various colors, such as silver, gold, green and blue which further enhances the decorative appearance of the instrument. Also, the entire face 8 of the guitar may be covered with this reflecting material, if desired.

While I have shown and described the reflected light rays as traveling through free space to receiver station 15, I also envision that they could be transmitted from the musical instrument to the receiving station by way of a fiber optics bundle (not shown), the bundle having a receiving end positioned adjacent the mirror 10 and a transmission end positioned adjacent photo-electric device 20.

I have also determined that several instruments could be amplified simultaneously by a single receiving station 15. In such cases, it is desirable to employ filter 17 in receiver 15 to insure that photo-electric device 20 is not overloaded.

While I have described certain presently preferred embodiments of my invention herein, it will become clear to those skilled in the art that certain modifications may be made without departing from the spirit and scope of the appended claims.

I claim:

1. In combination, a musical instrument and a sound amplifier system, comprising:

A. an acoustical guitar having a front face adjacent the strings thereof and a back face defining a sound box therebetween and light reflecting means coupled to one of said faces thereof adapted to vibrate responsive to the musical vibrations of the acoustical guitar said light reflecting means further adapted to modulate and reflect light rays transmitted from a source remote from the musical instrument; and;

B. receiving means at a point remote from the acoustical guitar including a photo-electric device to receive the modulated light rays from the reflecting means to produce electronic signals corresponding to musical tones associated with the modulated light rays and also including means to amplify said electronic signals in an audible range.

2. The sound amplifier system of claim 2 wherein the light reflecting means is positioned on the front face of the guitar.

3. The sound amplifier system of claim 2 wherein the light reflecting means includes a planar mirror attached to a spring member, the plane of the mirror being perpendicular to the longitudinal axis of the spring and means for mounting the spring to the front face of the guitar.

4. The sound amplifier system of claim 3 wherein the means for mounting the spring member to the guitar is a rubber suction cup.

5. The sound amplifier system of claim 2 wherein the light reflecting means comprises a planar mirror element having a bore therethrough said mirror moveably mounted through said bore on a shaft, said shaft extending outwardly from the front face of the guitar, whereby, the amplitude of the vibrations of said mirror may be selectively regulated by movement of said mirror element along said shaft.

6. The sound amplifier system of claim 2 wherein a portion of the front face of the guitar is transparent and the light reflecting means is positioned within the sound box of the guitar, associated with the back face of the guitar.

7. The sound amplifier system of claim 2 including light filtering means associated with the guitar, positioned between the light reflecting means and the remote light source to permit the selective regulation of intensity and color of the light rays striking the light reflecting means.

8. The sound amplifier system of claim 2 wherein the light reflecting means is mounted on the front face of the guitar, a cover member slidably mounted on said front face to permit the selective masking of the light reflecting means by movement of the cover member.

9. The sound amplifier system of claim 2 wherein the receiving means includes a lens element and a filter element, both elements disposed between the light reflecting means and the photoelectric device.

10. The sound amplifier system of claim 2 including a parabolic mirror element positioned intermediate the musical instrument and the receiving means to aid in directing the modulated light rays from the light reflecting means to the receiving means.

11. The sound amplifier system of claim 2 wherein the guitar also includes an undulating surface formed on the front face thereof whereby additional sound vibrations are generated when said undulating surface is scraped.

12. The sound amplifier system of claim 2 wherein the light reflecting means comprises flexible, plastic sheet material having a light reflecting surface on one side and a pressure sensitive adhesive on the other side.

* * * * *

UNITED STATES PATENT AND TRADEMARK OFFICE

CERTIFICATE OF CORRECTION

PATENT NO. : 4,028,977

DATED : June 14, 1977

INVENTOR(S) : John Joseph Ryeczek

It is certified that error appears in the above-identified patent and that said Letters Patent are hereby corrected as shown below:

Column 2 Line 21 "vibrate" should read --vibrates--.
Column 2 Line 46 "photoelectric" should read --photo-electric--.
Claim 2 - Column 5 Line 19 "claim 2" should read -- claim 1 --.
Claim 6 - Column 6 Line 3 "claim 2" should read --claim 1--.
Claim 8 - Column 6 Line 14 "claim 2" should read --claim 1--.
Claim 11 - Column 6 Line 28 "claim 2" should read --claim 1--.
Claim 12 - Column 6 Line 33 "claim 2" should read --claim 1--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*